US005543906A

United States Patent [19]

Kanda

[11] Patent Number: 5,543,906

[45] Date of Patent: Aug. 6, 1996

[54] CLEANING APPARATUS DISPOSED ON AN IMAGE FORMING APPARATUS

[75] Inventor: Shigemi Kanda, Atsugi, Japan

[73] Assignee: Ricoh Company, Ltd., Tokyo, Japan

[21] Appl. No.: 264,647

[22] Filed: Jun. 23, 1994

[30] Foreign Application Priority Data

Jun. 28, 1993 [JP] Japan ..... 5-157476

[51] Int. Cl.[6] ..... G03G 21/00

[52] U.S. Cl. ..... 355/299; 355/296; 355/301; 355/302

[58] Field of Search ..... 355/296, 297, 355/298, 299, 301, 302, 215

[56] References Cited

U.S. PATENT DOCUMENTS

| | | | |
|---|---|---|---|
| 4,251,155 | 2/1981 | Schnall et al. | 355/298 |
| 4,252,433 | 2/1981 | Sullivan | 355/298 |
| 4,427,289 | 1/1984 | Oda | 355/298 |
| 4,501,620 | 2/1985 | Oda | 355/298 X |
| 4,522,487 | 6/1985 | Misawa | 355/299 |
| 4,560,268 | 12/1985 | Nishimura | 355/298 |
| 4,640,608 | 2/1987 | Higaya et al. | 355/299 |
| 4,999,678 | 3/1991 | Tange | 355/297 |
| 5,031,000 | 7/1991 | Pozniakas et al. | 355/297 |
| 5,091,753 | 2/1992 | Slapelis | 355/297 |
| 5,111,251 | 5/1992 | Uno et al. | 355/297 |
| 5,220,391 | 6/1993 | Tange | 355/297 |
| 5,249,025 | 9/1993 | Nakazawa | 355/297 |

*Primary Examiner*—Sandra L. Brase
*Attorney, Agent, or Firm*—Oblon, Spivak, McClelland, Maier & Neustadt, P.C.

[57] ABSTRACT

A cleaning apparatus comprises a cleaning housing which has an opening and an accommodating part for accommodating removed toner. The opening faces an image bearing member. The apparatus further comprises a blade which covers part of the opening with the blade having one end which contacts the image bearing member, a cleaning roller, which is provided in the cleaning housing, for collecting toner which is removed by the blade and transporting the toner into the cleaning housing, and a scraper for scraping toner on the cleaning roller. The accommodating part for accumulating removed toner is partitioned by the scraper.

9 Claims, 2 Drawing Sheets

CLEANING APPARATUS DISPOSED ON AN IMAGE FORMING APPARATUS

BACKGROUND OF THE INVENTION

1. Field of the Invention

This invention relates to a cleaning apparatus, and particularly to a cleaning apparatus which is disposed on an image forming apparatus such as an electrophotographic copying machine, microfilm apparatus or laser beam printer etc.

2. Description of the Related Art

In a conventional image forming apparatus which repeats a step that transfers a toner image on a surface of an image bearing member (e.g. a photoconductive drum) onto recording material (such as paper), alien material (such as toner or paper dust etc.) remains after transferring. The alien material adversely effects the operation of the image forming apparatus. For that reason, it is an indispensable condition to provide a cleaning apparatus for removing the alien material to obtain a fine image.

As shown in FIG. 4, in a conventional cleaning apparatus 100 which is provided in an image forming apparatus having a image bearing member 103, a cleaning roller 101 such as a fur brush roller or a magnetic roller is disposed to mainly remove paper dust. Also, a cleaning blade 102 is provided downstream of the cleaning roller 101 to remove remaining toner together with the cleaning roller 101. The remaining toner and paper dust which are removed by the cleaning roller 101 and the cleaning blade 102 are collected and transported by the cleaning roller 101. A scraper 104 contacts the cleaning roller 101, thereby, the remaining toner and paper dust are collected into an accommodating part 105 of the cleaning housing 106.

The remaining toner or paper dust which are removed by the scraper 104 are accumulated in the accommodating part 105 of the cleaning housing 106. When the accommodating part 105 is filled with the alien material (remaining toner and/or paper dust), the cleaning apparatus 100 is exchanged for a new one.

However, in the conventional cleaning apparatus 100, when the cleaning apparatus 100 is exchanged, there is a problem that the remaining toner or paper dust spills from a gap between the cleaning blade 102 and the cleaning roller 101 of the cleaning apparatus 100, to thereby dirty the image forming apparatus.

SUMMARY OF THE INVENTION

An object of the present invention is to overcome the above and other problems encountered in the aforementioned art.

It is a further object of the present invention to provide a cleaning apparatus capable of being exchanged without being dirtied.

The above mentioned objects of the present invention are achieved by a cleaning apparatus. The cleaning apparatus includes a cleaning housing which has an opening and an accommodating part for accommodating removed toner, the opening faces an image bearing member, a blade which covers part of the opening, one end of which contacts the image bearing member, a cleaning roller, which is provided in the cleaning housing, for collecting toner which is removed by the blade and transporting the toner into the cleaning housing, and a scraper for scraping toner on the cleaning roller, the accommodating part for accumulating removed toner is partitioned by the scraper.

The scraper is fixed on the cleaning housing at one end and contacts the cleaning roller at the other end so as to cover part of the opening of the cleaning housing. Therefore, when exchanging the cleaning apparatus, remaining toner or paper dust which is accumulated in the accommodating part does not spill out.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
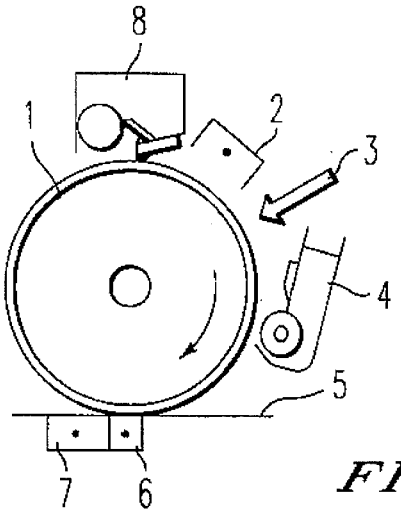
FIG. 1 is a schematic side view of an electrophotographic copying machine according to embodiments of the present invention.

Referring now to the drawings, wherein like reference numerals designate identical or corresponding parts throughout the several views, and more particularly to FIG. 1 thereof, FIG. 1 is a schematic side view of an electrophotographic copying machine according to embodiments of the present invention.

As shown in FIG. 1, after a photoconductive drum 1 is charged uniformly by a main charger 2, an electrostatic latent image is formed on the photoconductive drum 1 by image light 3. The latent image is made into a visible image by a developing member 4. The visible image, that is a toner image, is transferred on recording medium 5 by a transferring charger 6. The recording medium with a toner image is separated from the photoconductive drum 1 by a separating charger 7. At that time, alien material such as toner which remains on a surface of the photoconductive drum 1 and/or paper dust which attaches on the drum 1 etc. is removed by a cleaning apparatus 8, thereby, the next operation of copying is ready.

Figure 2:
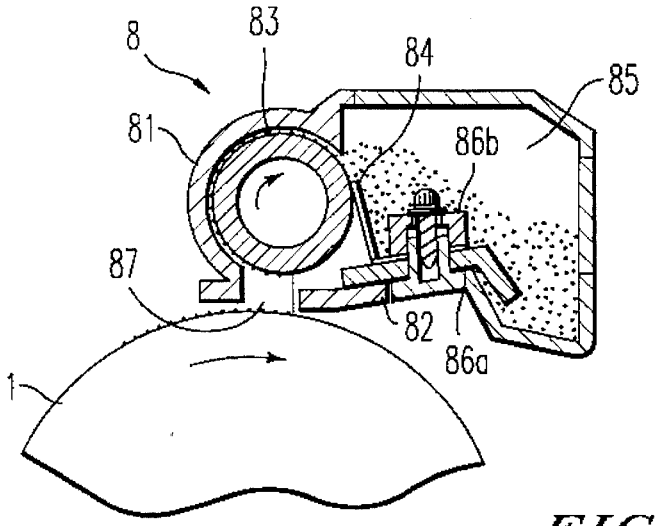
FIG. 2 is a side view of a significant portion of a cleaning apparatus according to the present invention.

As shown in FIG. 2, a cleaning housing 81 has an opening 87 which faces the photoconductive drum 1 and further includes an accommodating part 85 in its inside. A cleaning blade 82 is fixed via a supporting member **86*a* around the opening 87 of the cleaning housing 81 so as to contact a surface of the photoconductive drum 1 at one end of the cleaning blade 82. A magnetic roller 83 is disposed adjacent to the opening 87 over the photoconductive drum 1 and between the cleaning blade 82 and the cleaning housing 81. Further, a scraper 84 which contacts the magnetic roller 83 at one end and is fixed on the cleaning housing 81 at the other end is provided. The scraper 84 is provided within the cleaning housing 81 so as to cover a space, which leads to the opening 87 of the cleaning housing 81, between the cleaning blade 82 and the magnetic roller 83. Thereby, a sealed, covered or almost closed space is constructed and the space prevents accumulated toner from spilling from the accommodating part 85 when the cleaning apparatus is exchanged. The scraper 84 is provided via a fixing member 86***b* within the cleaning housing 81.

As mentioned above, part of toner remains on the photoconductive drum 1 after a toner image is transferred to recording material. The remaining toner on the photoconductive drum 1 reaches the cleaning apparatus 8 and then the remaining toner is scraped. The scraped toner adheres to the magnetic roller 83 by the magnetic roller's rotation and is transported into the cleaning housing 81. The transported toner is scraped from the magnetic roller 83 by the scraper 84 and further is collected into the accommodating part 85. When the accommodating part 85 is filled with toner or paper dust, the cleaning apparatus 8 is removed from the image forming apparatus and is exchanged.

Since the scraper 84 is provided so as to cover a space between the magnetic roller 83 and the cleaning blade 82 (the space leads to the opening 87 of the cleaning housing 81), in case of removing the cleaning apparatus 8 from the photoconductive drum 1, the remaining toner or paper dust which accumulated in the accommodating part 85 does not spill out.

The cleaning apparatus 8 is positioned slightly downstream from the highest point of the photoconductive drum 1 in the rotating direction of photoconductive drum 1. Thereby, the removed toner can be efficiently collected using gravity, since the accommodating part 85 is located under the contact point of the magnetic roller 83 and the scraper 84.

Figure 3:
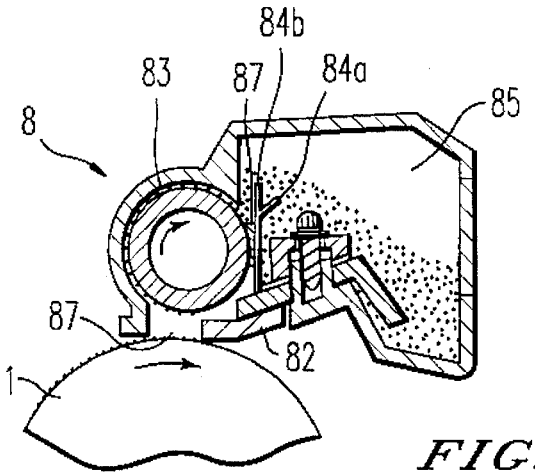
FIG. 3 is a side view of a significant portion of a cleaning apparatus according to another embodiment of the present invention.
Figure 4:
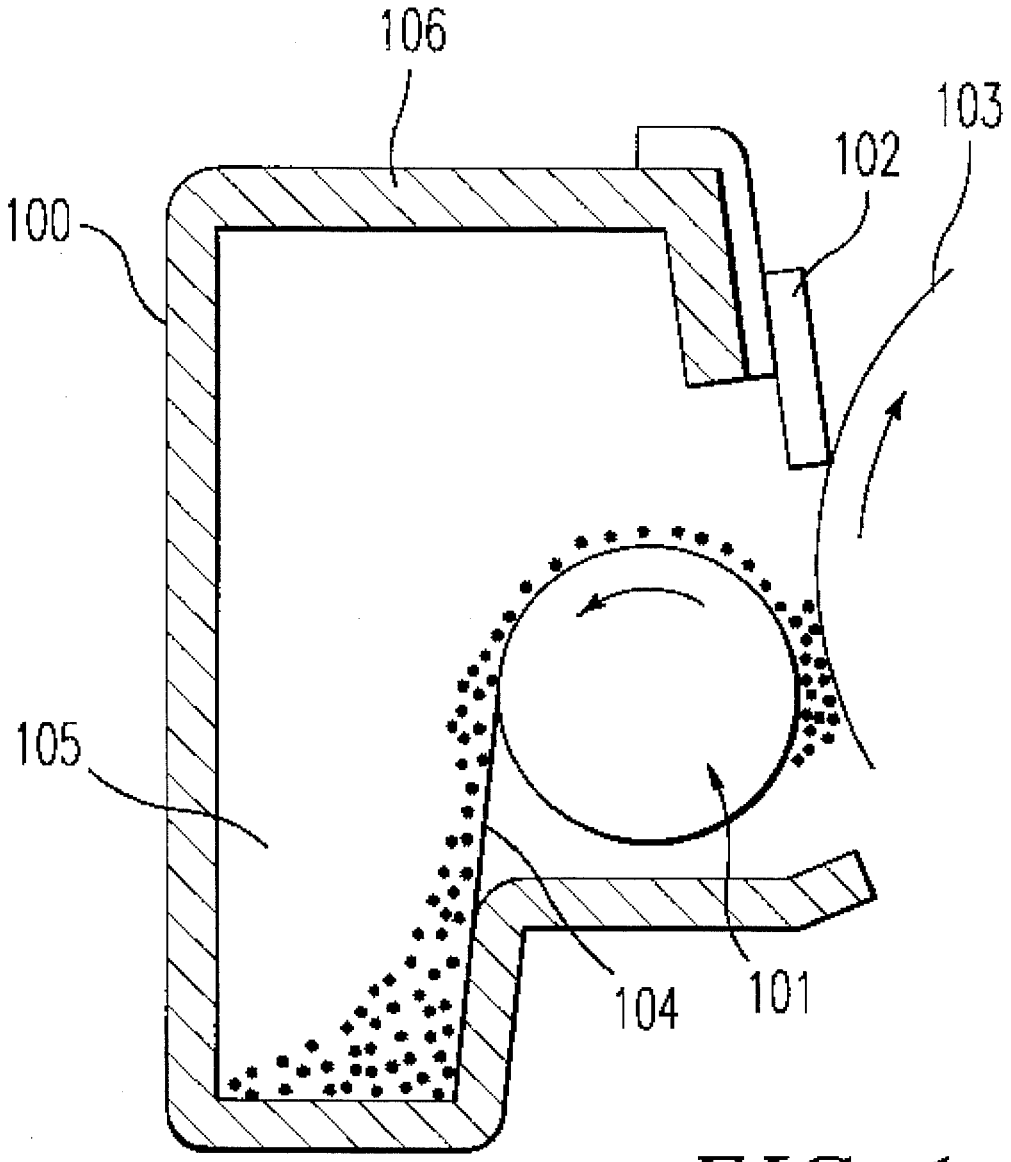
FIG. 4 PRIOR ART
FIG. 4 is a side view of a conventional cleaning apparatus.

As shown in FIG. 3, to scrape toner from the magnetic roller 83, a felt-like pad 87 can be used instead of using an edge 84*b*. The pad 87 is made of elastic material such as silicone rubber or urethane rubber. The pad is provided on one side 84*a* of the scraper 84 and contacts the magnetic roller 83. By using the scraper with the pad, it is possible to rough out positioning of the scraper against the magnetic roller 83 and further it is easy to install the scraper with the pad on the cleaning apparatus 8.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A cleaning apparatus comprising:

a cleaning housing having an opening and an accommodating part for accommodating removed toner, the opening of said cleaning housing facing an image bearing member;

a blade which covers part of said opening, said blade having one end which contacts said image bearing member;

a cleaning roller provided in said cleaning housing for collecting toner which is removed by said blade and transporting said toner into said cleaning housing; and a scraper for removing toner on said cleaning roller, such that the removed toner is accumulated in said accommodating part, the accommodating part being partitioned by said scraper, said scraper being downwardly inclined away from said cleaning roller such that a first end of the scraper contacts said cleaning roller and a second end of the scraper is spaced from the cleaning roller and secured to the housing, wherein a bottom of said accommodating part is disposed below the second end of the scraper;

wherein:

a tight channel is defined between an outer periphery of the cleaning roller and an inner periphery of the housing which surrounds the cleaning roller, such that at least a half of the outer periphery of the cleaning roller is covered by the housing, so that toner removed by the cleaning blade is transferred through the tight channel toward the accommodating part of the housing and prevented from flowing back toward the opening.

2. A cleaning apparatus according to claim 1, wherein said cleaning housing is located downstream from a top of said image bearing member in a rotating direction of said image bearing member.

3. A cleaning apparatus according to claim 1, further comprising a pad which is disposed on said scraper and contacts said cleaning roller.

4. A cleaning apparatus according to claim 1, wherein said scraper is provided within said cleaning housing so as to separate said accommodating part from a space defined between the cleaning roller and the blade which leads to said opening, to thereby prevent said removed toner removed by said scraper from spilling into said space.

5. A cleaning apparatus according to claim 1, wherein said first end of the scraper contacts said cleaning roller so as to oppose a rotating direction of said cleaning roller and a falling direction of said removed toner.

6. A cleaning apparatus according to claim 1, wherein said cleaning roller is a magnetic roller.

7. A cleaning apparatus according to claim 1, wherein the first end of the scraper is positioned adjacent to an outlet of the channel.

8. A cleaning apparatus according to claim 1, wherein the cleaning roller is spaced from the image bearing member.

9. A cleaning apparatus according to claim 1, wherein said scraper is disposed in said housing so as to close a passage between said blade and said cleaning roller which leads to the opening of said cleaning housing.

* * * * *